US008657562B2

(12) United States Patent
Burdgick et al.

(10) Patent No.: US 8,657,562 B2
(45) Date of Patent: Feb. 25, 2014

(54) SELF-ALIGNING FLOW SPLITTER FOR STEAM TURBINE

(75) Inventors: Steven Sebastian Burdgick, Schenectady, NY (US); Prashant Prabhakar Sankolli, Bangalore (IN)

(73) Assignee: General Electric Company, Schenectady, NY (US)

( * ) Notice: Subject to any disclaimer, the term of this patent is extended or adjusted under 35 U.S.C. 154(b) by 473 days.

(21) Appl. No.: 12/950,036

(22) Filed: Nov. 19, 2010

(65) Prior Publication Data

US 2012/0128465 A1 May 24, 2012

(51) Int. Cl.
*F01D 3/02* (2006.01)

(52) U.S. Cl.
USPC ..... 415/101; 415/190; 415/210.1

(58) Field of Classification Search
USPC ..... 415/108, 99, 100, 101, 103, 189, 190, 415/209.2–209.4, 210.1
See application file for complete search history.

(56) References Cited

U.S. PATENT DOCUMENTS

| | | | | |
|---|---|---|---|---|
| 5,249,918 | A * | 10/1993 | Knorowski | 415/108 |
| 5,593,273 | A * | 1/1997 | Brinkman | 415/108 |
| 7,322,789 | B2 * | 1/2008 | Burdgick | 415/103 |
| 7,357,618 | B2 * | 4/2008 | Burdgick et al. | 415/103 |
| 2003/0123979 | A1 * | 7/2003 | Mohammed-Fakir et al. | 415/189 |
| 2009/0217673 | A1 * | 9/2009 | Rivas et al. | 60/783 |

* cited by examiner

*Primary Examiner* — Edward Look
*Assistant Examiner* — William Grigos
(74) *Attorney, Agent, or Firm* — Hoffman Warnick LLC; Ernest G. Cusick

(57) ABSTRACT

A steam turbine diaphragm stage having a self-aligning flow splitter is disclosed. In one embodiment, a steam turbine flow splitter body is disclosed, the steam turbine flow splitter body having a central portion and two end portions, and including: a flow divider proximate to the central portion; and a substantially radially outward extending hook proximate to at least one of the two end portions.

18 Claims, 10 Drawing Sheets

SELF-ALIGNING FLOW SPLITTER FOR STEAM TURBINE

BACKGROUND OF THE INVENTION

The subject matter disclosed herein relates to a steam turbine nozzle assembly, or diaphragm stage. Specifically, the subject matter disclosed herein relates to a steam turbine diaphragm stage having a self-aligning flow splitter.

Steam turbine designs include static nozzle (or, airfoil) assemblies that direct the flow of a working fluid (e.g., steam) into turbine buckets (or, airfoils) connected to a rotating rotor. A complete assembly of nozzle segments is commonly referred to as a diaphragm stage, or nozzle assembly, of the steam turbine. Turbine diaphragms are conventionally assembled in two halves around the rotor, creating a horizontal joint. Some sections of conventional steam turbines have a double-flow design in which half of the fluid flow is provided to the left-hand portion of the diaphragm, and the other half of the fluid flow is provided to the right-hand portion of the diaphragm. The diaphragm stage that splits the flow (providing fluid to the left and right portions) is called a flow splitter (or, tub) stage.

Conventional flow splitter stages include left and right nozzle assemblies bolted at a flange. Due to the bolted designs and the limited accessibility associated with these designs, electron beam welding (or another deep penetration weld) is used to attach the flow splitter stage to left and right nozzle assemblies. Additionally, the size of the flange, bolt head and nut causes significant windage that may negatively affect turbine performance. These conventional designs and the welds associated with those designs may involve costly labor and cause distortion in the left and right nozzle assemblies, thereby diminishing the performance of the steam turbine.

BRIEF DESCRIPTION OF THE INVENTION

A steam turbine diaphragm stage having a self-aligning flow splitter is disclosed. In one embodiment, a steam turbine flow splitter body is disclosed having a central portion and two end portions, and comprising: a flow divider proximate to the central portion; and a substantially radially outward extending hook proximate to at least one of the two end portions.

A first aspect of the invention includes a steam turbine flow splitter body having a central portion and two end portions, the steam turbine flow splitter body comprising: a flow divider proximate to the central portion; and a substantially radially outward extending hook proximate to at lease one of the two end portions.

A second aspect of the invention includes a steam turbine flow splitter stage comprising: a flow splitter body having a central portion and an end portion, the flow splitter body including: a flow divider proximate the central portion; and a hook proximate the end portion; and a nozzle assembly coupled to the flow splitter body, the nozzle assembly having: a ring segment; and a flange extending from the ring segment, wherein the nozzle assembly is coupled to the flow splitter body at the hook by the flange.

A third aspect of the invention includes a steam turbine nozzle assembly having: a nozzle airfoil; a ring segment affixed to the nozzle airfoil; and a flange extending from the ring segment, the flange including: a first edge having a first chamfer angle; and a second edge having a second chamfer angle distinct from the first chamfer angle.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide for a steam turbine diaphragm stage having a self-aligning flow splitter. More specifically, aspects of the invention provide for a steam turbine flow splitter stage configured to hook to adjacent nozzle stages, allowing for reduced machining costs and improved turbine performance as compared to conventional flow splitter stages.

As described herein, conventional flow splitter stages include left and right nozzle assemblies bolted at a flange. Due to the bolted designs and the limited accessibility associated with these designs, electron beam welding (or another deep penetration weld) is used to attach the flow splitter stage to the other diaphragm stages. These conventional designs and the welds associated with those designs may involve costly labor and cause distortion in the nozzle assemblies, thereby diminishing the performance of the steam turbine.

Figure 1:
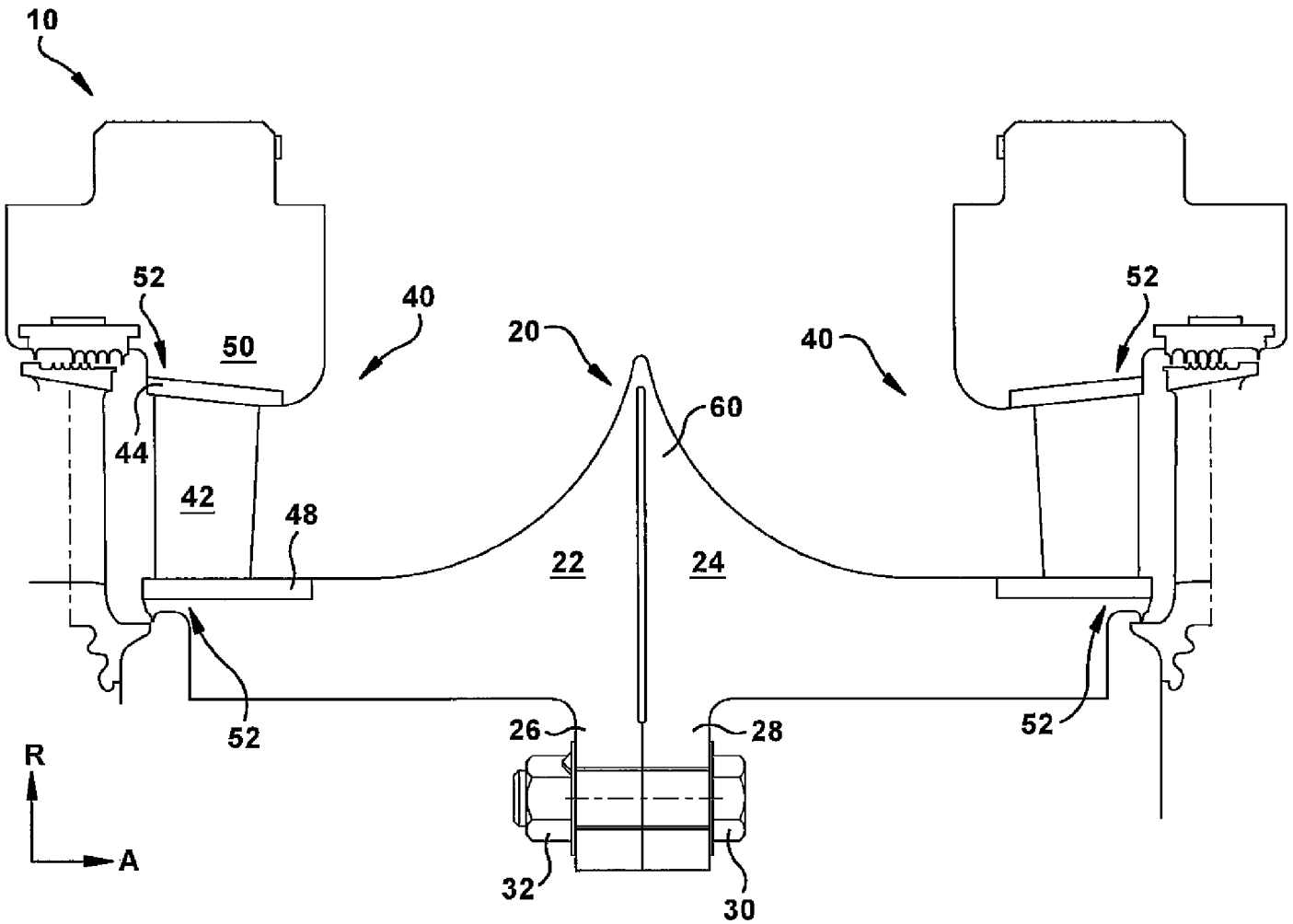
FIG. 1 PRIOR ART
FIG. 1 shows a two-dimensional side view of a conventional steam turbine flow splitter stage.

Turning to FIG. 1, a two-dimensional side view of a steam turbine flow splitter stage 10 is shown. Conventional steam turbine flow splitter stage 10 may include a flow splitter body 20, constructed in two segments 22 and 24, respectively. The segments 22, 24 of flow splitter body 20 may each include flanges 26 and 28, respectively, which may be attached by a bolt 30 (and, e.g. a nut 32). Also shown in conventional steam turbine flow splitter stage 10 is a nozzle assembly 40 including a static nozzle airfoil 42 connected to an outer band 44 and an inner band 48, respectively, as is known in the art. Outer band 44 may be welded to an outer ring 50 at a weld joint 52, and inner band 48 may be welded to splitter body 20 (e.g., at a first half 22) at another weld joint 52. Unlike other stages of a steam turbine, flow splitter stage 10 includes a flow splitter 60, which is used to divide the flow of steam entering the turbine stages and direct it toward each half of the double-flow turbine. This flow splitter 60 may extend radially outward from splitter body 20 such that it creates clearance-related problems in welding bands (e.g., outer band 44 and inner band 48) to each of the outer ring 50 and segments 22, 24. That is, forming the connection between inner band 48 and segment 22 (and in some cases, the connection between outer band 44 and outer ring 50) may be difficult due to the limited clearance available to access the interfaces between these components. Accordingly, weld joints 52 are conventionally formed from the axial back-side (or, axially outward side) of segments 22, 24 and outer ring 50, respectively. In order to form a sufficient bond between bands (e.g., outer band 44 and inner band 48) and segments 22, 24 and outer ring 50, respectively, electron-beam welding is conventionally employed. As is known in the art, electron beam welds may provide a deeper weld connection between the welded materials than other types of welds (e.g., metal inert gas or, MIG, welding). However, electron beam welding (EBW) is costly relative to MIG welding, and maintaining an electron beam welding machine may likewise be costly. While MIG welding may be less costly than EBW, MIG welding from only one side (e.g., the axial back-side) introduces a large amount of heat into the assembly that may cause distortion. That is, in the conventional flow splitter stage 10 of FIG. 1, with one-sided MIG welds 52 may cause deformation to bands (e.g., outer band 44 and inner band 48), rings (e.g., ring 50), flow splitter body 20 and/or nozzle airfoils 42. Deformation to these components may diminish the performance of a steam turbine employing flow splitter stage 10. Using two-sided MIG welding significantly reduces the distortion within the nozzle assembly when compared with one-sided MIG welding. Further, two-sided MIG welding offers a cost savings when compared with electron beam welding.

Figure 2:
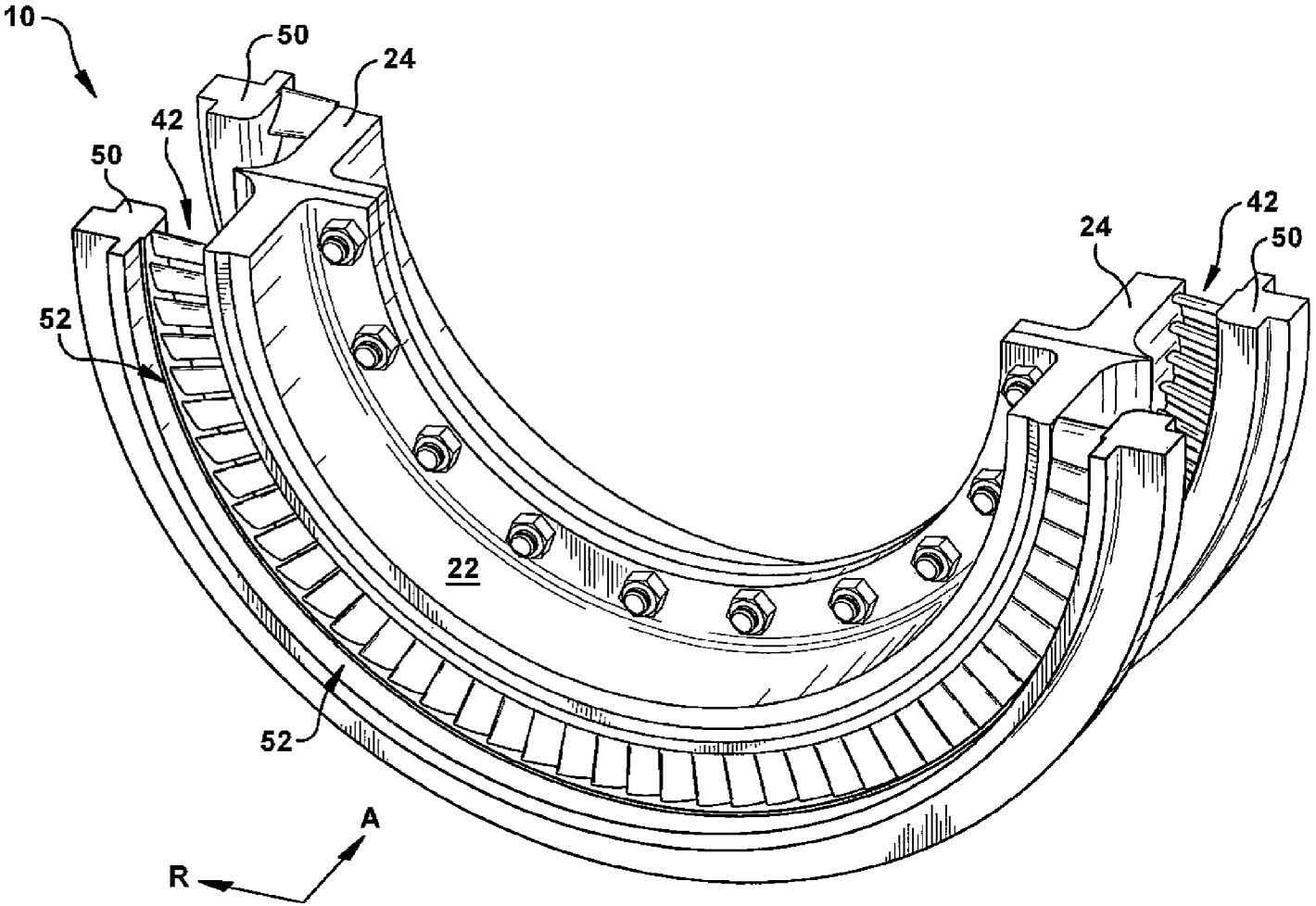
FIG. 2 PRIOR ART
FIG. 2 shows a three-dimensional perspective view of a conventional flow splitter stage.

FIG. 2 shows a three-dimensional perspective view of the conventional flow splitter stage 10 (lower half of stage shown here) excluding bolt 30 and nut 32. As is further illustrated in this three-dimensional perspective view, weld joints 52 may be formed from axially outward portions of outer ring 50 and segments 22, 24 due to the limited clearance from the axially inward portions of these components.

Figure 3:
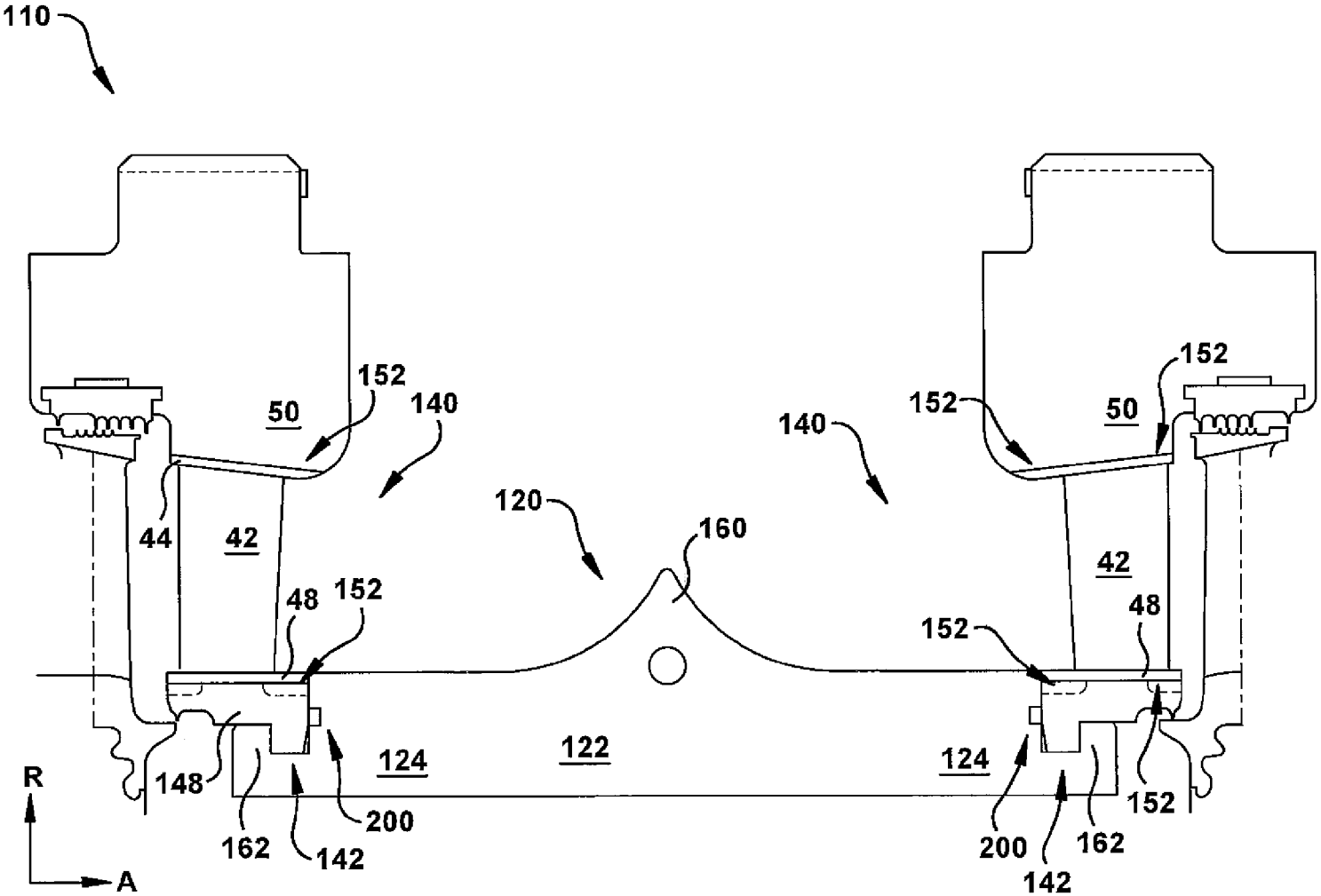
FIG. 3 shows a two-dimensional side view of a steam turbine flow splitter stage according to embodiments of the invention.

FIG. 3 shows a two-dimensional side view of a steam turbine flow splitter stage (or, flow splitter stage) 110 according to embodiments of the invention. In one embodiment, flow splitter stage 110 includes a flow splitter body 120 having a central portion 122 and two end portions 124 (e.g., axially outward of central portion 122). It is understood that "portions" of flow splitter body 120 are merely general distinctions between sections of the component. In some cases, a physical division does not exist between portions of flow splitter body 120, and in some embodiments, flow splitter body 120 may be formed of a single piece of material (e.g., a metal). Flow splitter body 120 is shown including a flow divider 160 proximate to central portion 122, and a hook 162 proximate to each end portion 124. Flow divider 160 may be substantially radially extending, and in some embodiments, extends radially to a lesser extent (e.g., having a smaller profile) than in conventional flow splitter stages. It is understood that hook 162 may be formed as a flange and groove or slot (labeled and described with reference to FIG. 4) configured to couple with a nozzle assembly 140. In particular, hook 162 may be configured to couple with a flange 142 extending from an inner ring 148. As will be described further herein, hook 162 may include a radially extending flange configured to interact with an oppositely radially extending flange of inner ring 148. In another embodiment, flow splitter body may include multiple hooks 162 configured to couple with one or more flanges 142 extending from an inner ring. Flow splitter body 120 is further shown including an internal slot 200. Internal slot 200 may be configured to, e.g., receive a seal device (not shown) for preventing fluid flow through the interface between flow splitter body 120 and inner ring 148. Another benefit of the hook and flange configuration (e.g., hook 162 coupled with flange 142) is that this configuration retains the flow splitter body (e.g., flow splitter body 120) inside of the nozzle assembly (e.g., nozzle assembly 140) once the nozzle assembly is sequentially assembled into the turbine. If the nozzle assembly flange (e.g., flange 42) were directed radially outboard versus inboard, then the nozzle assembly flange would not retain the flow splitter body therein. Internal slot 200 and corresponding seal device will be explained further herein.

As shown in FIG. 3, flow splitter stage 110 may include a flow splitter 160 having a reduced radial length as compared to the conventional flow splitter (e.g., flow splitter 60 of FIG. 1). Additionally, in one embodiment, flow splitter stage 110 may be formed of a single piece of material (e.g., a metal), in contrast to the two-segment design in FIG. 1. The reduced radial length of flow splitter 160 may allow, e.g., an operator to access axially inward portions of junctions between rings (e.g., inner ring 148 and outer ring 50) and bands (e.g., inner band 48 and outer band 44), respectively, to perform two-sided welding of the joints. That is, in contrast to conventional approaches, two-sided, lower-temperature welds 152 may be used to couple bands (inner band 48 and outer band 44) and rings (e.g., inner ring 148 and outer ring 50) together, thereby increasing the overall strength of the bond between each band and ring. For example, in one embodiment, the design of flow splitter stage 110 may allow for the use of gas metal arc welding (GMAW), such as, e.g., metal inert gas (MIG) welding or metal active gas (MAG) welding, or Gas Tungsten Arc Welding (GTAW) to form welds 152 between bands and rings. In any case, flow splitter stage 110 may allow for access from both axial directions (inner and outer) in order to facilitate lower temperature welds 152, thereby reducing the damage caused to components (e.g., bands, rings, airfoils, etc.) by welding when compared with conventional approaches. Additionally, the lack of a flange-and-bolt connection in flow splitter stage 110 (as compared with the conventional stage of FIGS. 1-2) allows for greater radial clearance for rotor-related components (not shown).

Figure 4:
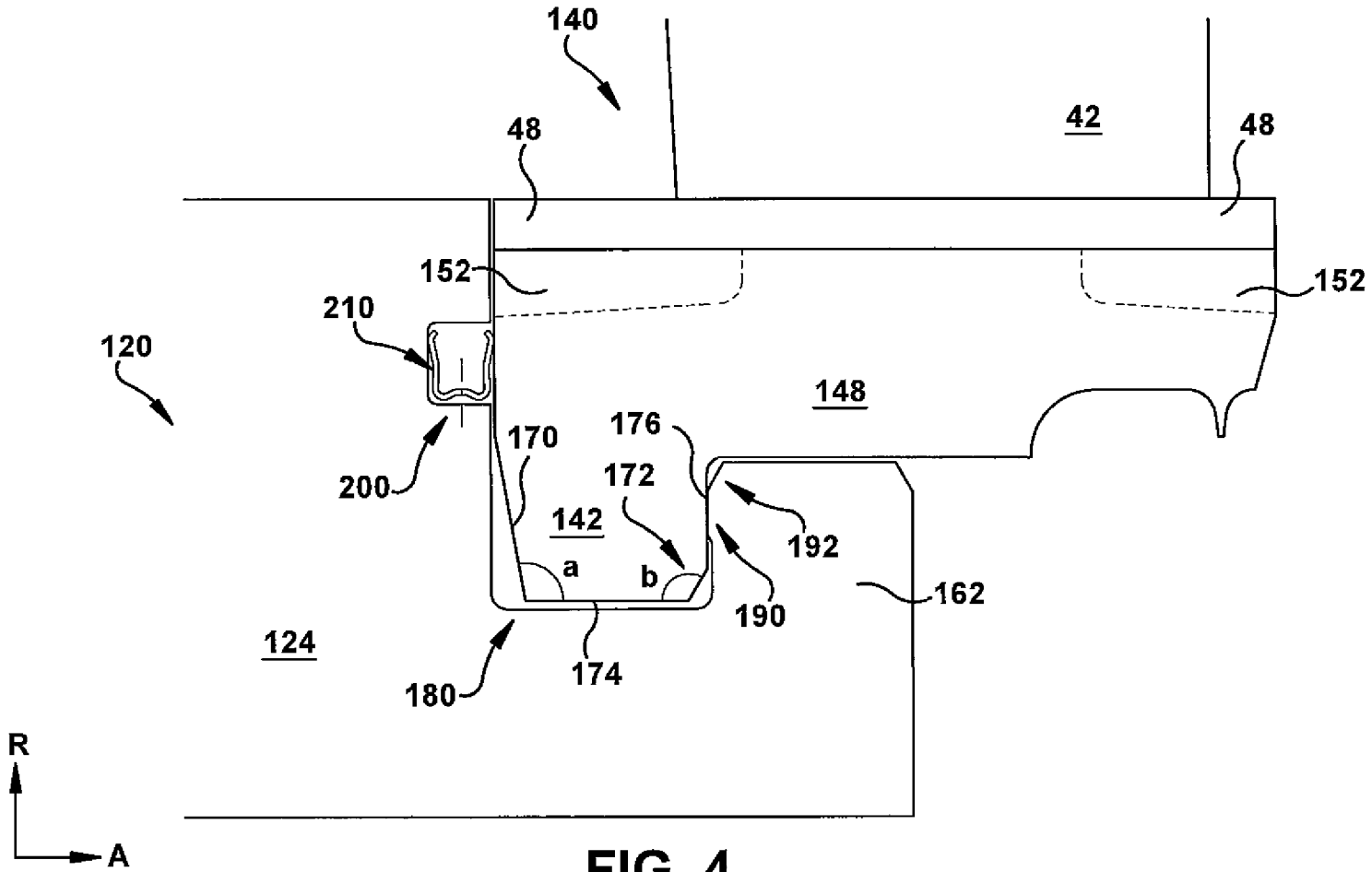
FIG. 4 shows a close-up two-dimensional side view of the flow splitter stage of FIG. 3 according to embodiments of the invention.

Turning to FIG. 4, a close-up two-dimensional side view of the flow splitter stage of FIG. 3 is shown. In particular, end portion 124 of flow splitter body 120 is shown along with portions of nozzle assembly 140. As shown, inner ring segment 148 may include a flange 142 extending therefrom, the flange 142 being configured to couple with hook-shaped portion 162 of flow splitter body 120 proximate to end portion 124. Flange 142 may include one or more angled edges (or, faces) 170, 172 configured to allow flange 142 to interact with hook 162 and slide within a groove (or, slot) 180 in flow splitter body 120. In one embodiment, flange 142 may include a first edge 170 having a first chamfer angle (a) and a second edge 172 having a second chamfer angle (b) with respect to a radially inward edge 174 of flange 142. In one embodiment, first edge 170 and second edge 172 may be formed at different angles (where (a) is not equal to (b)); however, it is possible that angles (a) and (b) may be equal in other embodiments. First edge 170 and second edge 172 may be machined or otherwise formed at angles (a) and (b), respectively, in order to allow for inner ring segment 148 to be slid into place axially within groove 180. That is, after securing flange 142 in groove 180, there may be clearance between portions of first edge 170 and a wall of groove 180 and second edge 172 and another wall of groove 180, respectively. Also shown in FIG. 4, hook 162 may include a ledge (or contact face) 190 extending axially inward toward the center portion 122 (FIG. 3) of flow splitter body 120. Ledge 190 may contact an axially outward facing edge 176 of flange 142, and may work as a contact point between flange 142 and flow splitter body 120. Hook 162 may also include an angled face 192 proximate to its tip, the angled face 192 allowing for inner ring segment 148 to slide into place (or, out of place when desired) axially within groove 180.

Also shown in flow splitter body 120 is a slot 200 configured to receive a seal 210, for e.g., preventing fluid flow across the interfaces (and cavities) between flange 142 and flow splitter body 120. In one embodiment, slot 200 is located axially inward of hook 162, however, in other embodiments shown and described herein, slot 200 (and corresponding seal 210) may be located in other portions of flow splitter body 120. In one embodiment, seal 210 is a multi-convolution seal (e.g., a "v" seal or "w" seal), known in the art and capable of expanding to fill a space in at least one direction (e.g., radial and/or axial direction, depending upon positioning within a slot).

It is understood that seal 210 may not be pre-compressed within flow splitter stage 110, and accordingly, movement of the inner ring segment 148 into groove 180 may force the pressurization of seal 210 within slot 200. That is, the first edge 170 may be formed at an angle (a) sufficient to allow it to compress seal 210 while flange 142 is loaded into groove 180. It is understood that the angles (a) and (b) that respectively define relationships between first edge 170 and second edge 172 with radially inward edge 174, may be any angles allowing first edge 170 and second edge 172 to be loaded into groove 180 and pressurize seal 210.

Figure 5:
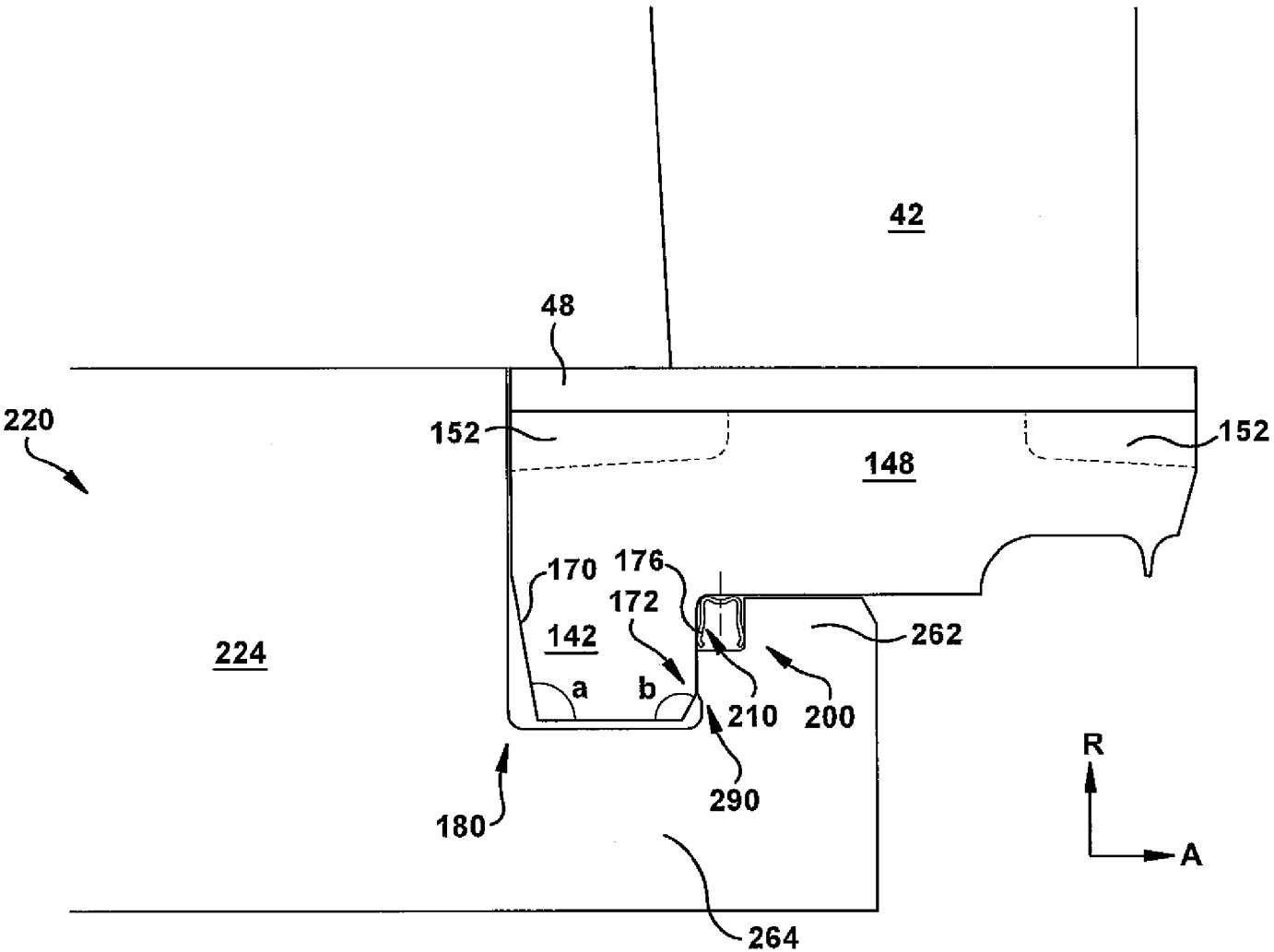
FIG. 5 shows a close-up two-dimensional side view of an alternate embodiment of a flow splitter body according to embodiments of the invention.

Turning to FIG. 5, a close-up two-dimensional side view of an alternate embodiment of a flow splitter body 220 (and in particular, an end portion 224 of flow splitter body 220) is shown having a slot 200 located proximate to a hook portion 262. In this embodiment, flow splitter body 220 may include a hook portion 262 having a slot 200 included therein. That is, the radially extending hook portion 262 may be configured to receive a seal 210 (similar to seal 210 described with reference to FIG. 4), and effectively seal cavities between portions of flange 142 and internal surfaces of groove 180. As described with reference to FIG. 4, seal 210 may be compressed during loading of flange 142 into groove 180, thereby pressurizing cavities between inner ring segment 148 and end portion 224. In contrast to the hook (162) of FIG. 4, flow splitter body 220 of FIG. 5 may not include a ledge 190 and angled face 192 proximate to its tip portion. In this case, flow splitter body 220 may include a ledge 290 located proximate to a bend in the hook portion 262, near the junction of an axially extending portion 264 and the hook portion 262.

Figure 6:
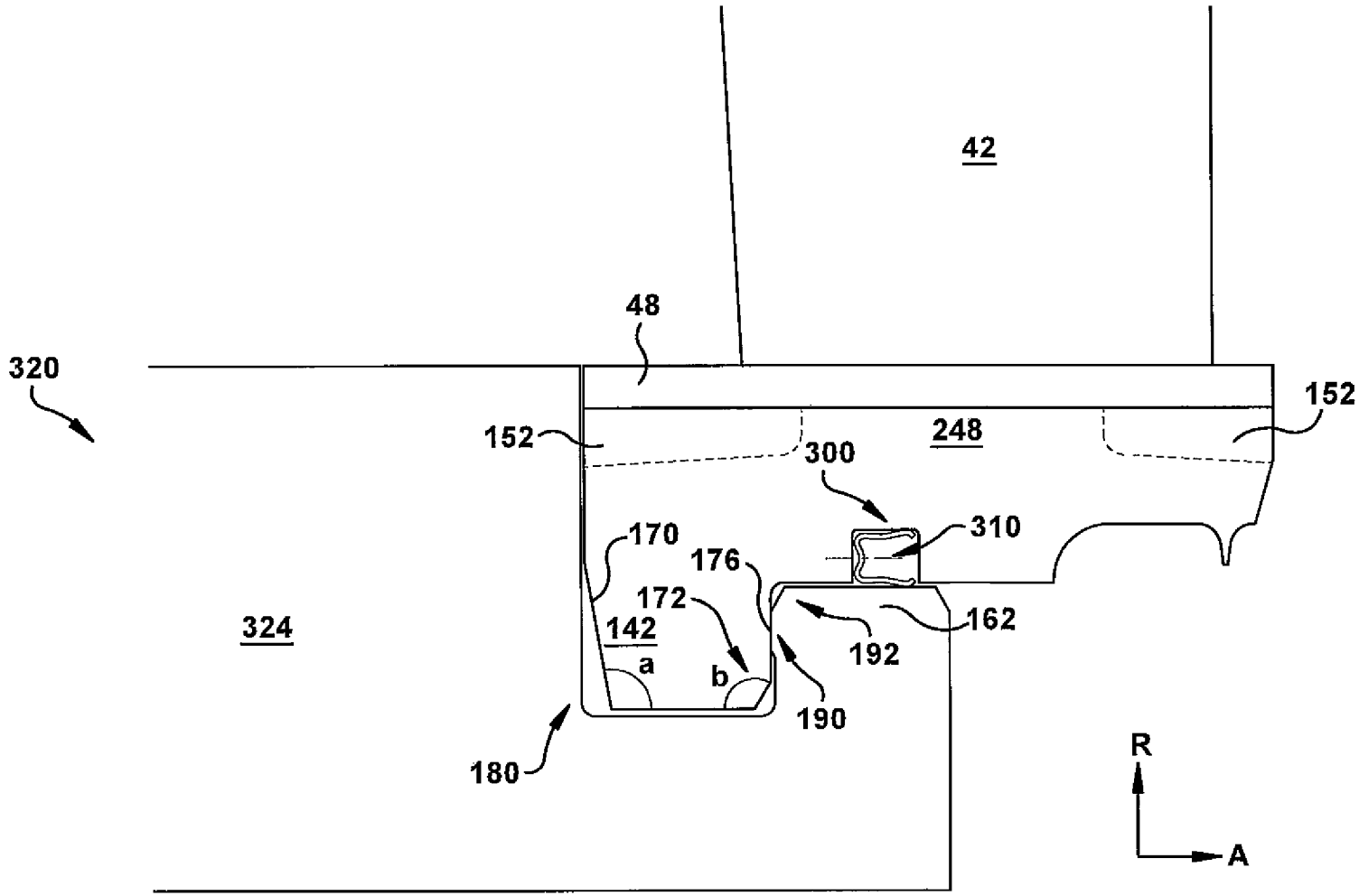
FIG. 6 shows a close-up two-dimensional side view of an alternate embodiment of an inner ring segment according to embodiments of the invention.

Turning to FIG. 6, a close-up two-dimensional side view of an alternate embodiment of an inner ring segment 248 is shown having an internal slot 300 located within a radially inward facing wall configured to contact the hook 162 of a flow splitter body 320. In this embodiment, slot 300 may be formed within inner ring segment 248, and may be configured to receive a seal 310, which may be substantially similar to a form of seal described with reference to seal 210 of FIGS. 4-5. In any case, as with slot 200 and seal 210, slot 300 and slot 310, respectively, may be configured to prevent the flow of fluid through cavities between inner ring segment 248 and the inner walls of groove 180. As with seal 210, seal 310 may be pressurized during loading of inner ring segment 248 into groove 180 (that is, seal 310 may not be pre-compressed). In this embodiment, inner ring segment 248 may be configured to connect with a flow splitter body 320 (having an end portion 324) not having a slot for receiving a seal.

Figure 7:
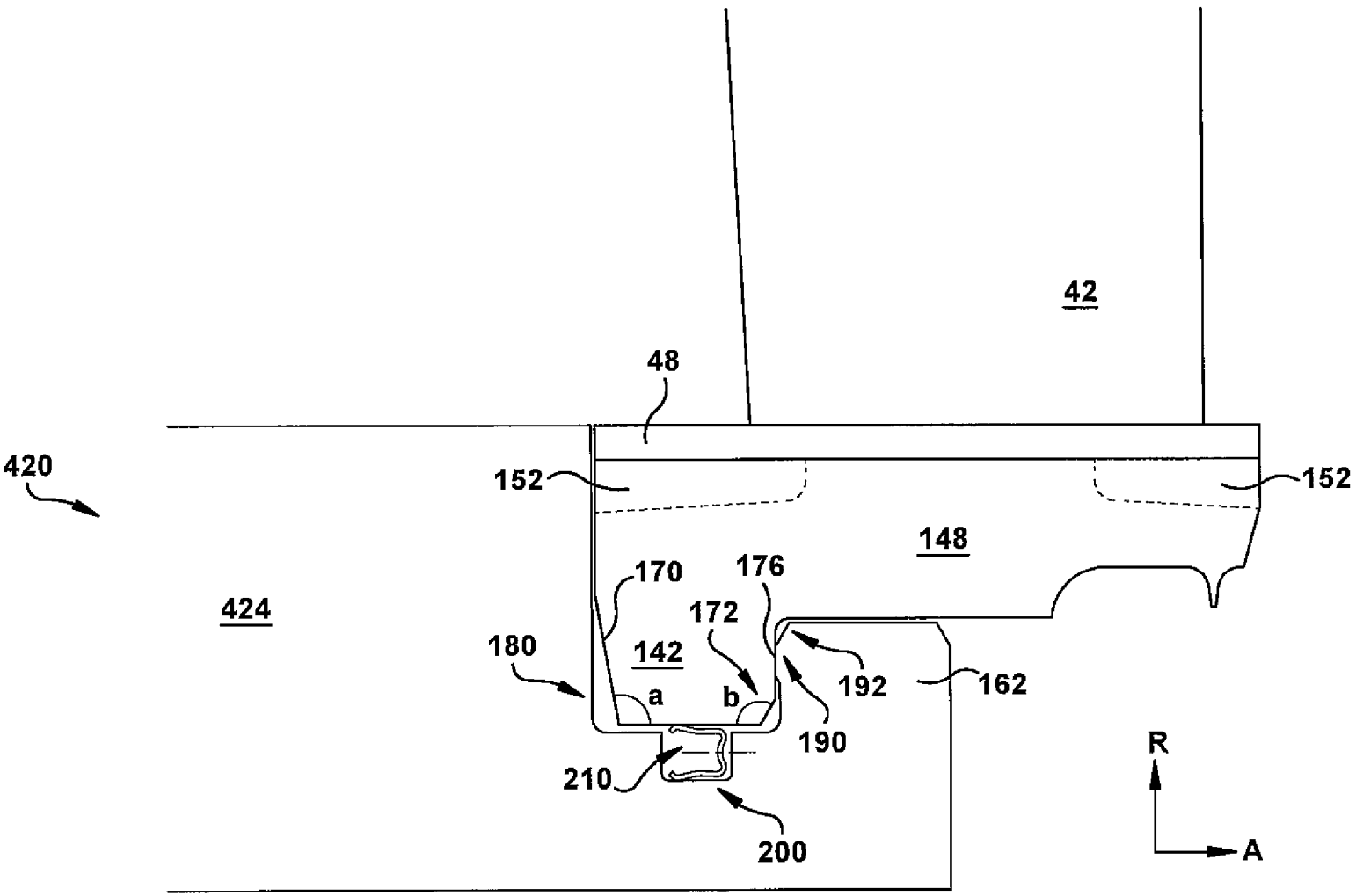
FIG. 7 shows a close-up two-dimensional side view of an alternate embodiment of a flow splitter body according to embodiments of the invention.

Turning to FIG. 7, a close-up two-dimensional side view of an alternate embodiment of a flow splitter body 420 (and in particular, an end portion 424 of flow splitter body 420) is shown having a slot 200 located proximate to a radially inward portion of groove 180 (and adjacent a radially inward edge 174 of flange 142, shown in FIG. 4). In this embodiment, slot 200 may be located at the interface of radially facing edges of flange 142 and groove 180. Slot 200 may be configured to receive a seal 210, and effectively seal cavities between portions of flange 142 and internal surfaces of groove 180. As described with reference to FIGS. 4-5, seal 210 may be compressed during loading of flange 142 into groove 180, thereby pressurizing cavities between inner ring segment 148 and groove 180.

Figure 8:
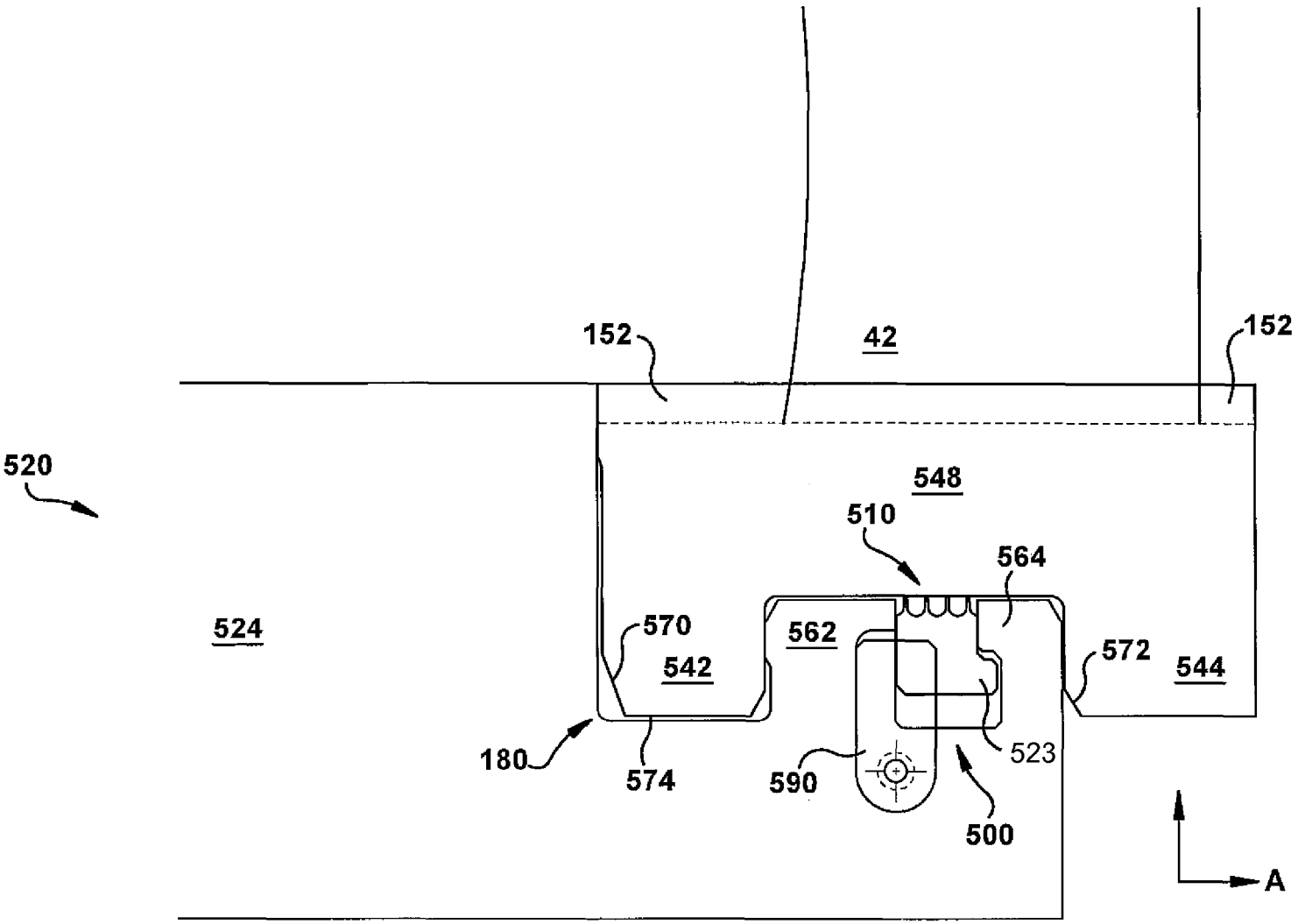
FIG. 8 shows a close-up two-dimensional side view of an alternate embodiment of a flow splitter body and inner ring segment according to embodiments of the invention.

Tuning to FIG. 8, a close-up two-dimensional side view of an alternate embodiment of a flow splitter body 520 and inner ring segment 548 is shown. In this embodiment, flow splitter body 520 (and in particular, end portion 524) is shown including a groove 180 (which may be substantially similar to groove 180 shown and described with reference to FIGS. 4-6), and an internal slot 500 for receiving a spring-loaded seal 510. Spring-loaded seal may be any conventional seal mechanism configured to expand to fill slot 500 in at least one direction. As shown, slot 500 may include an "L" shaped or "J" shaped opening configured to receive a flange or extension portion 523 of seal 510. As with slots and grooves shown and described herein, slot 500 may be machined or otherwise formed in an existing piece of material, or may be e.g., cast as a shape within a flow splitter body (e.g., flow splitter body 520). In one embodiment, slot 500 may be located axially outward of hook 562. Also shown in FIG. 8 is a key 590 (which may be any conventional key), configured to prevent anti-rotation of inner ring segment 548 with respect to flow splitter body 520. It is understood that a key, substantially similar to key 590 or others known in the art, may be used in conjunction with other embodiments described and shown herein to, among other things, prevent anti-rotation of inner ring segments with respect to a flow splitter body.

Additionally shown in FIG. 8 is the inner ring segment 548 including a first flange 542 and a second flange 544. First flange 542 may include substantially similar features as shown and described with respect to flange 142 of FIGS. 4-7, however, flange 542 may include edges (e.g., edge 570) having different angular relationships with adjacent edges (e.g., a radially inner facing edge 574) than in flange 142. Also shown, second flange 544 may include at least one angled edge (or, chamfer) 572, which may allow inner ring segment 548 to engage with flow splitter body 520 prior to forming of welds 152.

Figure 9:
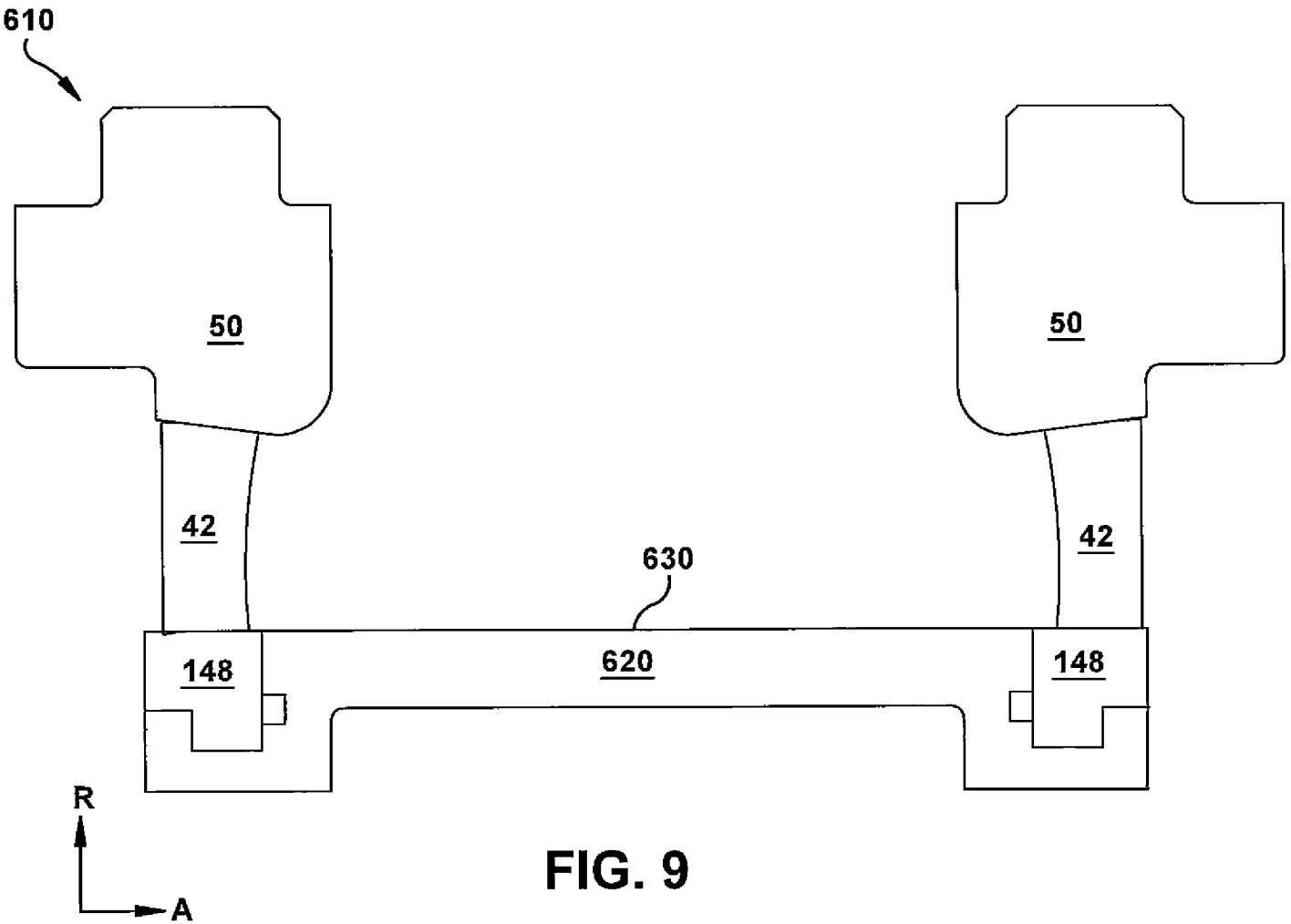
FIG. 9 shows a simplified two-dimensional side view of a steam turbine flow splitter stage according to embodiments of the invention.

FIG. 9 shows a simplified two-dimensional side view of a steam turbine flow splitter stage 610 according to embodiments of the invention. In this case, steam turbine flow splitter stage 610 is shown including a flow splitter body 620 having a substantially flat radially outward surface 630. That is, in this embodiment, flow splitter body 620 does not include a traditional "flow splitter" as shown and described with reference to FIGS. 1-2, or a flow divider 160 according to embodiments of the invention which is shown and described with reference to FIG. 3. It is understood that while flow splitter body 620 is shown in conjunction with inner ring segment 148, flow splitter body 620 may be configured to include aspects of any other embodiment described herein, e.g., varying placement of slots, seal types, etc. As such, flow splitter body 620 may be configured to interact with any other inner ring segment shown or described herein.

Figure 10:
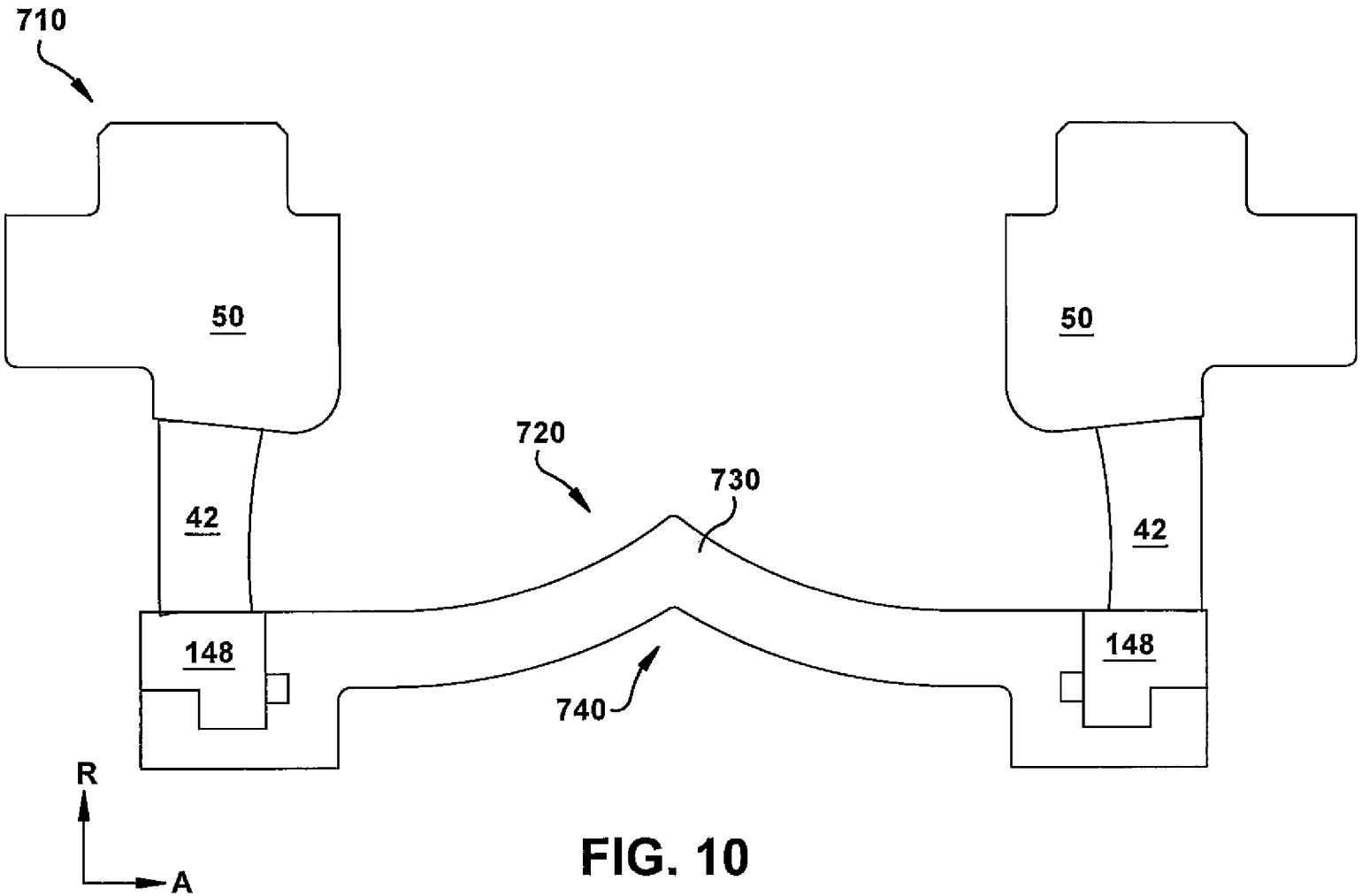
FIG. 10 shows a simplified two-dimensional side view of a steam turbine flow splitter stage according to embodiments of the invention.

FIG. 10 shows a simplified two-dimensional side view of a steam turbine flow splitter stage 710 according to embodiments of the invention. In this case, steam turbine flow splitter stage 710 includes a flow splitter body 720 having a substantially radially extending flow splitter 730, and an undercut region 740. That is, in this embodiment, flow splitter body 720 may be formed from a single piece of material (e.g., a metal) in which an undercut region 740 (or void) is created beneath flow splitter 730. In one embodiment, flow splitter body 720 may be cast from a mold, thereby avoiding the time and expense of machining undercut region 740. In any case, as with flow splitter body 620 (FIG. 10), flow splitter body 720 may be configured to include aspects of any other embodiment described herein, e.g., varying placement of slots, seal types, etc. As such, flow splitter body 720 may be configured to interact with any other inner ring segment shown or described herein.

It is understood that additional aspects of the invention include the presence of a seal (e.g., seal 210) substantially contained within the flow splitter body (e.g., flow splitter body 120) or the inner ring segment (e.g., inner ring segment 248). Location of the seal within a slot allows the seal to expand to fill a cavity between the inner ring segment and the flow splitter body.

It is further understood that aspects of the invention allow the flow splitter body (e.g., flow splitter body 120) to "self-align" as it is heated by steam entering the system. That is, because the flow splitter body is not supported at the horizontal joints by traditional support bars (or, "lugs"), the flow splitter body shifts as it heats up during the introduction of steam to the system. This may allow the flow splitter body to "self-align" when it heats, thereby closing the radial gap between the flow splitter body and respective nozzle assemblies. This may allow for centering, and locking, of the flow splitter body within the flow splitter stage (e.g., flow splitter stage 110).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine flow splitter body having a central portion and two end portions, the steam turbine flow splitter body comprising:

a flow divider proximate to the central portion;

a substantially radially outward extending hook proximate to at least one of the two end portions, wherein the substantially radially outward extending hook is configured to receive a flange of a nozzle assembly; and an internal slot located within the steam turbine flow splitter body between the steam turbine flow splitter body and the flange of the nozzle assembly.

2. The steam turbine flow splitter body of claim 1, wherein the flow divider includes a substantially radially extending portion.

3. The steam turbine flow splitter body of claim 2, wherein the substantially radially extending portion of the flow divider extends radially outward.

4. The steam turbine flow splitter body of claim 1, wherein the internal slot is located axially outward of the hook.

5. The steam turbine flow splitter body of claim 1, wherein the flow divider includes an undercut region and is cast from a single piece of metal.

6. A steam turbine flow splitter stage comprising:

a flow splitter body having a central portion and an end portion, the flow splitter body including:

a flow divider proximate the central portion;

a hook proximate to the end portion; and an internal slot located within the steam turbine flow splitter body; and a nozzle assembly coupled to the flow splitter body, the nozzle assembly having:

a ring segment; and a flange extending from the ring segment, wherein the nozzle assembly is coupled to the flow splitter body at the hook by the flange, wherein the internal slot is located between the steam turbine flow splitter body and the flange of the nozzle assembly.

7. The steam turbine flow splitter stage of claim 6, wherein the hook includes a substantially radially extending portion and the flange includes a substantially radially extending portion.

8. The steam turbine flow splitter stage of claim 7, wherein the flow divider includes a substantially radially extending portion.

9. The steam turbine flow splitter stage of claim 8, wherein the substantially radially extending portion of each of the hook and the flow divider extend in approximately the same direction.

10. The steam turbine flow splitter stage of claim 6, further comprising a seal apparatus substantially filling the slot in at least one direction.

11. The steam turbine flow splitter stage of claim 6, wherein the flange has at least one angled face.

12. The steam turbine flow splitter stage of claim 6, wherein the flow splitter body is configured to expand when heated to substantially lock with the nozzle assembly.

13. The steam turbine flow splitter body of claim 1, wherein the internal slot is located within the substantially radially outwardly extending hook.

14. The steam turbine flow splitter body of claim 13, wherein the internal slot is located within a radially facing surface of the substantially radially outwardly extending hook.

15. The steam turbine flow splitter body of claim 13, wherein the internal slot is located within an axially facing surface of the substantially radially outwardly extending hook.

16. The steam turbine flow splitter stage of claim 6, wherein the internal slot is located within the substantially radially outwardly extending hook.

17. The steam turbine flow splitter stage of claim 16, wherein the internal slot is located within a radially facing surface of the substantially radially outwardly extending hook.

18. The steam turbine flow splitter stage of claim 16, wherein the internal slot is located within an axially facing surface of the substantially radially outwardly extending hook.

* * * * *